United States Patent [19]

Wiita

[11] Patent Number: 4,864,306

[45] Date of Patent: Sep. 5, 1989

[54] RAILWAY ANTICOLLISION APPARATUS AND METHOD

[76] Inventor: Floyd L. Wiita, 331 W. Clayton Ave., Clayton, N.J. 08312

[21] Appl. No.: 877,255

[22] Filed: Jun. 23, 1986

[51] Int. Cl.[4] ..... G08G 1/00

[52] U.S. Cl. ..... 342/42; 340/991; 246/122 R

[58] Field of Search ..... 342/42, 44, 50, 33, 342/41; 340/991, 47; 246/122, 167, 218

[56] References Cited

U.S. PATENT DOCUMENTS

| | | | |
|---|---|---|---|
| 1,747,041 | 2/1930 | Alexanderson . | |
| 2,762,913 | 9/1956 | Jepson | 250/2 |
| 3,209,350 | 9/1965 | Davis et al. | 340/47 |
| 3,235,025 | 2/1966 | Quinn | 180/82.1 |
| 3,264,614 | 8/1966 | Hellström | 340/47 |
| 3,305,682 | 2/1967 | Bolster | 246/167 |
| 3,544,788 | 12/1970 | Guzik | 246/63 |
| 3,636,508 | 1/1972 | Ogilvy et al. | 340/47 |
| 3,639,731 | 2/1972 | McNeill | 340/47 X |
| 3,644,883 | 2/1972 | Borman et al. | 340/991 |
| 3,714,650 | 1/1973 | Fuller et al. | 342/42 |
| 3,787,679 | 1/1974 | Birkin | 246/30 |
| 3,790,780 | 2/1974 | Helmcke | 246/187 |
| 3,824,469 | 7/1974 | Pistonbatt | 342/42 |
| 3,940,630 | 2/1976 | Bergonz | 340/991 |
| 3,940,765 | 2/1976 | Grafinger | 343/6.8 R |
| 3,964,702 | 6/1976 | Lardennois | 246/4 |
| 4,015,807 | 4/1977 | Bourree | 246/187 B |
| 4,027,840 | 6/1977 | Blair | 342/42 X |
| 4,038,653 | 7/1977 | Brewster | 342/42 |
| 4,040,053 | 8/1977 | Olsson | 343/6.5 R |
| 4,041,448 | 8/1977 | Noens | 340/32 |
| 4,107,675 | 8/1978 | Sellers et al. | 342/42 |
| 4,133,505 | 1/1979 | Bongiorno | 246/167 |
| 4,210,084 | 7/1980 | Peltie | 104/178 |
| 4,296,901 | 10/1981 | Perrott | 246/167 R |
| 4,508,298 | 4/1985 | Salmon | 246/167 R |
| 4,524,931 | 6/1985 | Nilsson | 246/167 D |

*Primary Examiner*—Thomas H. Tarcza
*Assistant Examiner*—Mark Hellner
*Attorney, Agent, or Firm*—Charles F. Duffield

[57] ABSTRACT

A railway anticollision apparatus and method is disclosed in which machine readable trackside markers such as bar code markers are utilized along the track and are read by apparatus on board the train to provide track number identification, milepost identification and train direction. On board the train is equipment to provide train identification and train speed. This information is transmitted through transponders between trains and to a central station and is processed by apparatus on board the respective trains and the central location to provide visual and audible signals indicative of a potential train collision.

6 Claims, 4 Drawing Sheets

RAILWAY ANTICOLLISION APPARATUS AND METHOD

BACKGROUND OF INVENTION

The present invention relates in general to automatic signaling and train control systems for railroads and the like and especially high speed rail routes and, more particularly, to systems for automatically indicating the identity, track number, positioned direction and speed of a given train which is transmitted to other trains within a prescribed locality and to a central station all of which is utilized to calculate conditions of impending danger.

Railway signaling devices and, more specifically, those utilized to warn one train of the proximity of another train have been around for many many years. The most fundamental of such devices is the railway flare which is dropped from the rear of a train and burns for a prescribed time indicating the proximity of one train to another by the simple fact that the flare is still burning upon the approach of another train.

As the evolution of the railway industry proceeded, it naturally became important that the proximity of one train to another and thus the possibility of a collision be determined with greater precision. One system which came into use was the so-called block system. In this system, blocks of track were separated by rail insulation. As the train proceeded from one block to another, electrical signals were carried along ground lines to indicate when a train moved from one block to another and thus generate data useful in determining potential collision situations. As trains began operating at higher speeds and in greater frequencies along single or multiple tracks, the block system became inadequate due to the rather extensive expanse from one block to another and thus the timing inaccuracies.

The pressure on the railway industry for ever more efficient systems started the advent of systems which would more accurately determine a given train identity, position, direction and provide appropriate alarms and/or stop signals upon the proximity of two or more trains reaching a critical situation.

These systems employed a number of different transmission systems for the signals generated. One type of transmission would be along the actual rails themselves and/or along antenna wires carried along the railway tracks. In another system, the transmitted signals would be by radio wave transmission to transmitters/receivers associated with the various trains and/or central stations along which the various data would be transmitted, analyzed and the various signal situations generated.

In systems of the foregoing nature, one of the most important and critical pieces of data, i.e. train position, would be created by means of such devices as magnetic transducers positioned selectively along the railway. In these systems, a train positioned at a reference point, i.e. a given terminal position, would be initialized and thereafter that train position reading altered by passing over the magnetic transducers. Such systems would provide train identity, train direction and train position.

One of the disadvantages of the initial reference system is the inherent chance of error. Of course, the system must be initialized to the reference point at the beginning or all data will likewise be in error as will the data if the on train system malfunctions. Additionally, the transducers, upon passage of the train, are subject to variation and failure to register an appropriate count and thus then the entire system is out of calibration creating a further potential danger. Thus, these rather complex initial reference systems, due to their complexity, have inherent accuracy problems and, likewise, are rather expensive both in production and maintenance.

What is desired is an inexpensive and effective system for indicating train railway data such as train position, train direction and track identification which is independent of on train carried equipment and inalterable in its character and operation.

SUMMARY OF INVENTION

The railway vehicle and collision system of the present invention utilizes directional radio wave transmission/reception between individual rail units and/or a central station as the basic communications medium. A transponder consisting of a transmitter and transceiver system is located in the front and rear of each of the respective vehicles and transmits and receives in a backward or forward direction as optically readable the individual case may be.

Machine readable trackside markers such as bar code markers are placed along the trackside in specific and/or strategic locations. These bar code markers will provide, for each specific location, the information of a precise track position, track number and direction of travel of the particular train reading the bar code marker by means of an optical bar code reader.

Carried on board the train and working in conjunction with the transmitter/receiver system of each train is a specifically encoded train ID signal and a train speedometer system creating a train speed signal. In this manner, each particular train generates and stores the specific information of train identification, track identification, trackside position, train direction and train speed.

At a prescribed interval, the transponder system of a given train will transmit both forwardly and rearwardly a signal providing the information of a synchronizing signal, the train identification, the track identification, the train track position, the train direction and the speed of the train. Internal data processing within the transmitting train will verify that the transmitted data is, in fact, the data generated and stored in that particular train's transponder system and also will set the system so as to ignore reflected signals from its own train transponder system.

Any train which is forward or rearward of the transmitting train and within reception distance of the transmitting transponder will receive and process the transmitted data. The receiving transponder system will likewise have its relevant data stored in its system and will compare the received data from its own relevant data in a comparator. Where, for example, the comparator indicates that the trains are on different tracks, then no further processing will occur. Likewise, depending upon the perimeters set within the comparing system, i.e. proximity of the two trains on the same track being within a prescribed distance, one of the two trains on the same track being stopped indicating a failure or derailment or two trains on the same track converging will create various alarm signals and responses as well as a visual display being provided to the operator of the receiving train.

The receiving transponder system will, simultaneously, transmit in response to the initial train's transmitting signal its data back to the initial transmitting transponder system as well as to any other transponder systems within reception distance. In this manner, the initially transponding train will likewise then compare all such data and generate the same data processing response.

DETAILED DESCRIPTION OF INVENTION

A. Transponder signal components

The railway anticollision system of the present invention will employ a multitude of optical machine readable trackside markers such as optically readable bar code markers. These bar code markers will be placed on either side of a given track and along each side of multiple tracks at particular mileposts and at other strategic locations. These bar code markers are readable by a optical bar code reader carried by a given train. The bar code markers provide in their markings the data of track position or milepost, direction of travel of the train as determined by the direction the train is heading when the particular marker is read and the particular track, i.e. number of track upon which the train is positioned.

Carried on board the train and as a part of the transponder system, as will be described in more detail hereinafter, are signal generators which will generate a signal indicative of the identity of a particular train and also the speed of the train. Additionally, an odometer may be utilized in the transponder system which will further correct the track position read from a given bar code marker between interceptions of given markers.

Figure 1:
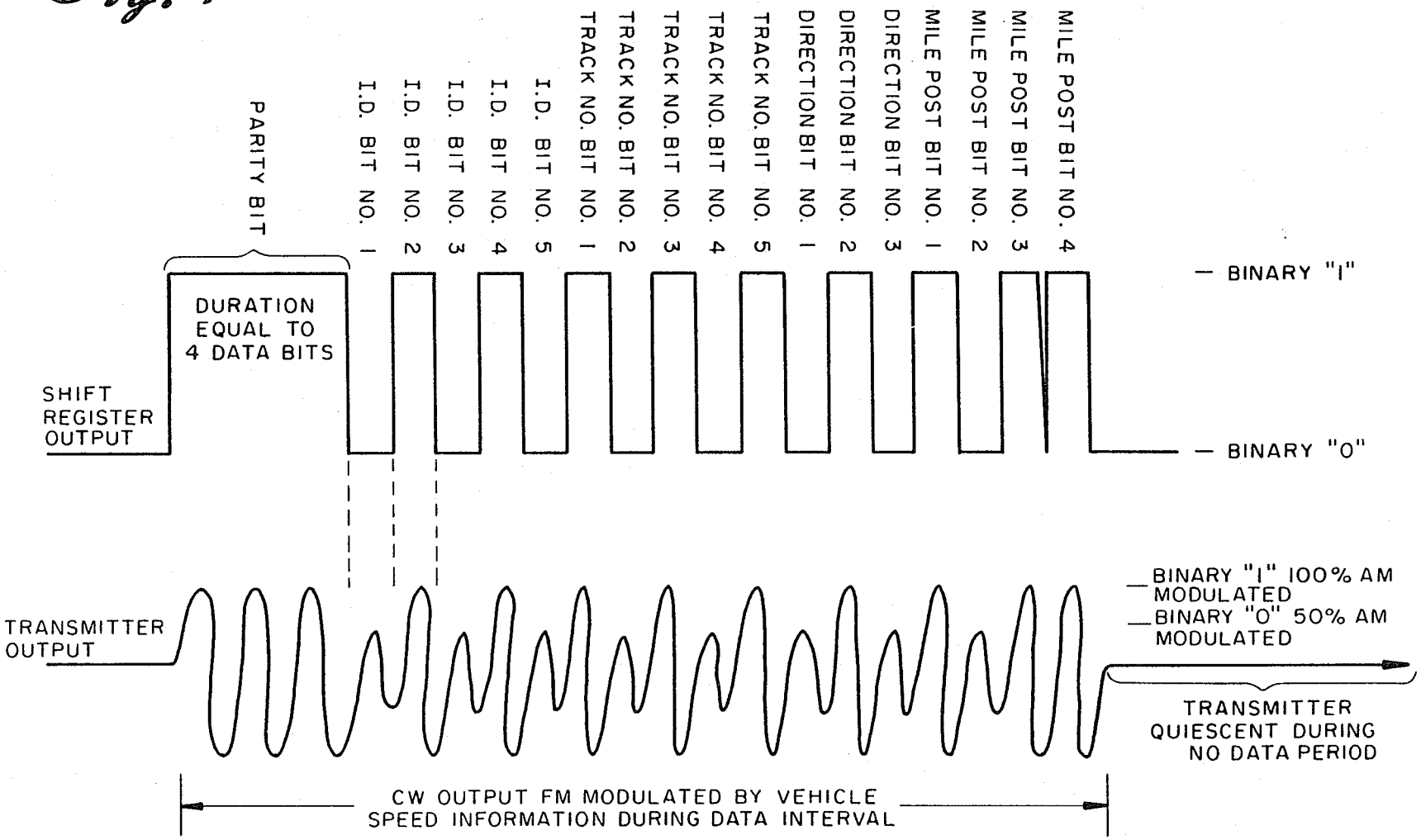
FIG. 1 is a schematic diagram of the data levels and data content of the radio frequency carrier during a given transmission interval of a transponder system.

Illustrated in FIG. 1 is the content and format of a signal transmitted from a given transponder system by radio wave propagation in a given transmission interval.

Before discussing FIG. 1 in detail, set out hereinafter is a definition of the terms utilized in FIG. 1.

"Parity bit" is one of 4 bits equal in amplitude to a binary 1 data bit and is used to lock all processed data to time zero. The bits originate in the microprocessor.

"ID bits" are a series of binary 1's and 0's which identify each rail operated vehicle with an identity peculiar to that vehicle only. These bits are assigned and preset into the microprocessor on each rail vehicle.

"Track #bits" are a series of binary 1's and O's which identify each railroad section with an identity peculiar to that section only. Parallel paths require different designations. A section is considered to mean a portion with no junctions or intersections. This information is posted on bar coded chart signs adjacent to the track.

"Direction bits" are a series of binary 1's and O's which identify the general direction of the track from terminal to terminal or junction to junction, i.e. North=000, NE 32 001, East=010, SE=011, South =100, SW=101, West=110, NW=111. This information is posted on bar coded chart signs adjacent to the tracks.

"Milepost bits" are a series of binary 1's and O's which further define a specific portion along a specific railroad. This information is posted on bar coded chart signs and is updated by an odometer on the rail vehicle between sign placements. Sign posted information has precedence. (i.e. Railroad sections with a high density of activity require bar coded charts as follows: Mile 0=00000, Mile 1=00001, Mile 2=00010, Mile 3=00011, etc. Sections with minimal density of activity: Mile 0=00000, Mile 10=00001, Mile 20=00010, Mile 30=00011, etc.)

"Speed" is a continuously sinusoidal FM deviation of the CW carrier during the entire time period that the transponder is transmitting vehicle address information. An analog voltage supplied by a speedometer mounted on the rail operated vehicle and directly proportional to the vehicle's forward speed, sinusoidally FM modulates the transmission carrier proportional to that speed. (i.e. vehicle stopped and/or derailed; carrier remains at fo. Vehicle proceeding forward to 100 mph; carrier varies from fo to fo+100 kHz and back to fo continuously and sinusoidally. Vehicle backing at 25 mph, carrier varies from fo to fo−25 kHz and back to fo continuously and sinusoidally.)

The transmitted signal will be a continuous wave at a characteristic frequency of fo which signal is amplitude modulated by fixed and variable binary pulse information while simultaneously being frequency modulated by analog information and having a peak power of approximately 3 watts.

At the beginning of every transmission which is initiated upon predetermined time intervals by the transponder system, the first information transmitted, as will be seen in FIG. 1, is a parity bit of 4 data bits. The parity bits will be equal in amplitude to a binary 1 data bit and have a duration equal to 4 data bits. The parity bit is created in the microprocessor of the transponder system of the transmitting transponder and used to lock all data in receiving transponders to a uniformed starting point (time zero.)

The remaining binary data content of the transmitted signal will be variable depending upon the variable involved, i.e. train identification, track identification, train direction and train milepost position. This binary information is modulated 100% for a binary 1 and 50% for a binary 0 as illustrated in the lower portion of FIG. 1.

As may be seen from the upper portion of FIG. 1, the train identity portion of the binary expression for the modulated continuous wave signal consists of a 5 bit signal. The track number likewise is a 5 bit signal while that for the train direction and the milepost position is a 4 bit signal. The number of bits for a given variable are for illustration purposes only and may, of course, be varied as conditions require.

As may be seen from the lower portion of FIG. 1, the vehicle speed information is applied to the continuous wave in the form of frequency modulation. By way of example and not limitation, the modulation of the carrier may go from fo to+100 kHz for a forward direction from 0 to 100 miles with a proportionate reduction in carrier frequency for a negative or reverse speed of the vehicle.

B. Transponder system and data processing

Figure 2:
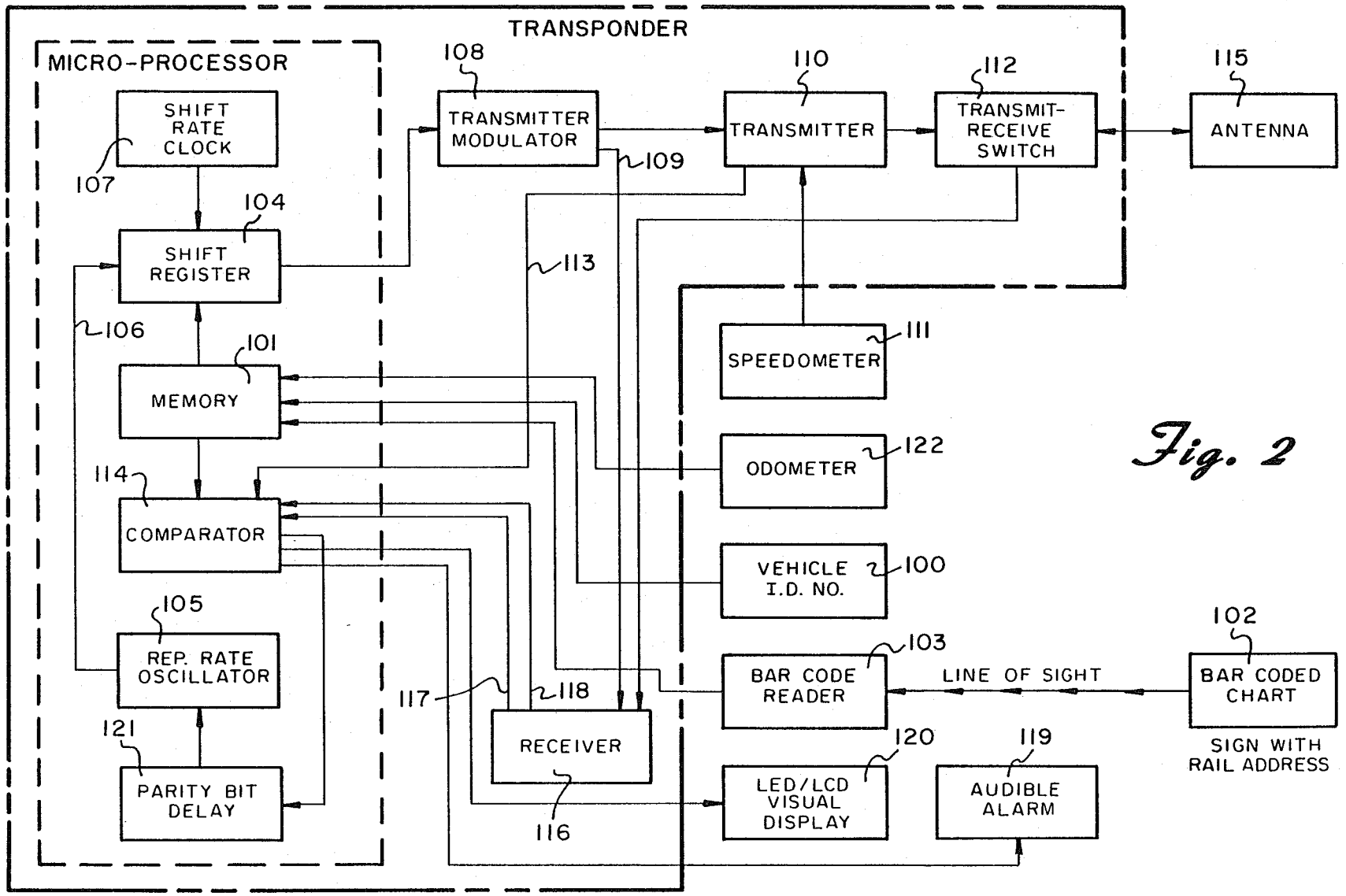
FIG. 2 is a block diagram illustration of a transponder system of the present invention.

A block diagram of the transponder system of the railway anticollision apparatus and method of the present invention is shown in FIG. 2 of the drawings. The transponder's sequence of operation is as follows: a vehicle identification number memory device 100 contains a preset fixed binary information numerically peculiar to the parent rail operated vehicle and is sent to the microprocessor memory 101.

Bar coded chart signs 102 are placed adjacent to the rail vehicle's path and all signs are of uniform height, angle orientation and distance from the assigned track. The bars on the signs must be horizontally polarized and uniform in orientation with respect to the vehicle's direction of travel. Routes which support travel in both directions on a single set of tracks require bar coded chart signs oriented as stated above for each direction of travel. Routes having more than one set of tracks require separate rail addresses for each set of tracks.

A bar code reader 103 reads the bar coded rail address and sends the track identification, train direction and train position to the microprocessor memory 101. The microprocessor memory 101 will continuously maintain the most current vehicle location and status information and will create the parity bit information and will supply all its information to a shift register 104.

A repetition rate oscillator 105 is provided and should have a free running rate of approximately one pulse per second. The oscillator will supply a shift pulse on line 106 to the shift register 104.

When the shift register 104 receives the shift pulse, it will serially shift all stored data at a rate established by a shift rate clock 107 to a transmitter modulator 108. The shift rate clock 107 frequency should be 2 to 4 MHz and will determine the duration of each data bit.

When the transmitter modulator 108 receives the input from the shift register 104, it will supply a receiver disabling voltage on line 109 and provide binary AM modulation to a transmitter 110 which provides a CW carrier for the entire data period.

A speedometer device 111 supplies the transmitter 110 with an analog voltage which is directly proportional to the vehicle's speed and which will cause the CW carrier frequency (fo) to sinusoidally FM deviate from its characteristic frequency throughout the data transmission period proportional to the vehicle's speed, i.e.:

| Direction | Speed | Analog V | Frequency deviation |
|---|---|---|---|
| Forward | 100 mph | +10 V | fo to fo +100 kHz |
| Forward | 50 mph | +5 V | fo to fo +50 kHz |
| Stopped | 0 mph | 0 V | fo |
| Backing | 25 mph | −2.5 V | fo to fo −25 kHz. |

The RF output from the transmitter 110 will be coupled to a transmit receive switch 112. A calibrated attenuated and detected transmitter 110 output on line 113 will be fed to a comparator 114 where it will be used to self test or verify that the transmitted data matches the data stored in memory 101 and that the transmitter 110 output power level is 75% of nominal or greater. An appropriate error signal and response will be made if the comparison is in error.

The transmit receive switch 112 will automatically electronically switch the transmitter 110 RF output to a directional antenna 115 during the entire vehicle address information data period. At all other times the transmit receive switch 112 will automatically electronically switch the RF connection from the directional antenna 115 to the receiver 116.

The receiver 116, in a receiving transponder unit, will detect the amplitude modulated binary data from the RF component and process it to the comparator 114 via line 117. The receiver 116 will also discriminate the frequency modulated speed information from the RF component and process it to the comparator 114 via line 118.

The comparator 114 receives from the memory 101 samples of all stored vehicle status information and uses it as reference data to which all other data will be compared. If the received data identification number matches the reference data, the entire communication is rejected as it is an extraneous reflection of the receiving vehicle's own transmitted vehicle data. If the vehicle identification number does not match, it is next compared for track number. If the track number data does not match, it is disregarded.

If the track number does match, the comparator 114 will process the entire communication and will supply that information to a LED/LCD visual display 120 in the vehicle operator's compartment, i.e. the transmitting vehicle's identification number, track position, track direction and track speed. Additionally, an audible alarm 119 in the vehicle operator's compartment is sounded.

During the data processing above, the comparator 114 will process the parity bit to a parity bit delay device 121. The purpose of the parity bit delay device 121 is to select one of eight fixed delays each of which should be different and in increments 10% greater than one data transmission interval. The delay selection is automatic, continuously changing and accomplished at random. This will minimize possible interference of data transmission periods of two or more transponders responding coincidentally when three or more transponders are within one another's proximity.

The parity bit delay device 121 will provide a signal to the repetition rate oscillator 105 which will shorten the oscillator's interval from a free running rate of approximately one pulse per second (1PPS) to approximately one pulse every 750 milliseconds. This feature will lock any two or more transponders communications to each other's communication while they are within one another's proximity with the one having the greatest receiver sensitivity having assumed the role of master control.

An odometer 122 is provided to update the milepost data stored in the memory 101 between bar coded charts 102 on railroad systems where the placement of the charts can be greatly separated. The bar coded chart signs always have precedence.

Each transponder will have a power supply with a battery pack capable of supplying B+ voltage for 24 hours after the loss of source voltage. In normal operation, B+ voltage and battery charging voltage is supplied from a train source voltage via an isolation diode. In an emergency, the isolation diode would provide isolation of B+ from the vehicle's voltage source.

C. Vehicle situations and response

1. Parallel tracks, normal operation, all vehicles moving at the same speed.

Figure 3:
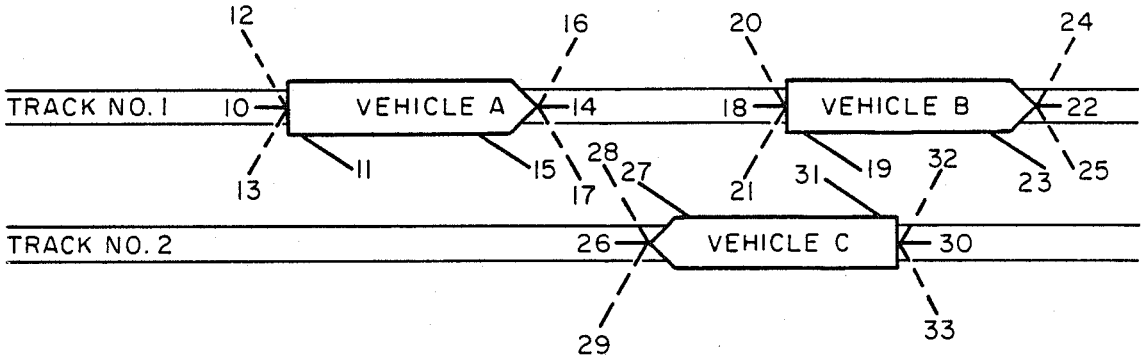
FIG. 3 illustrates vehicles A and B traveling in the same direction on track 1 and vehicle C traveling in the opposite direction on parallel track 2.

Referring now to FIG. 3, vehicle A is traveling from left to right on track 1. One transponder 10 is mounted at the rear end of vehicle A transmitting vehicle A address information as per FIG. 1 based on information supplied by bar code reader 11 within a beam pattern indicated by dashed lines 12 and 13. Another transponder 14 is mounted at the front end of vehicle A transmitting vehicle A address information as per FIG. 1 based on information supplied by bar code reader 15 within a beam pattern indicated by dashed lines 16 and 17.

Vehicle B is traveling from left to right on track 1. One transponder 18 is mounted at the rear end of vehicle B transmitting vehicle B address information as per FIG. 1 based on information supplied by bar code reader 19 within a beam pattern indicated b dashed lines 20 and 21 and one transponder 22 is mounted at the front end of vehicle B transmitting vehicle B address information as per FIG. 1 based on information supplied by bar code reader 23 within a beam pattern indicated by dashed lines 24 and 25.

Vehicle C is traveling from right to left on track 2. One transponder 26 is mounted at the front end of vehicle C transmitting vehicle C address information as per FIG. 1 based on information supplied by ar code reader 27 within a beam pattern indicated by dashed lines 28 and 29 and one transponder 30 is mounted at the rear end of vehicle C transmitting vehicle C address information as per FIG. 1 based on information supplied by bar code reader 31 within a beam pattern indicated by dashed lines 32 and 33.

Transponders 10, 22 and 30 receive no transmission signals from any other transponders in this illustration.

Transponder 26 on vehicle C receives vehicle address information from transponder 14 on vehicle A and transponder 14 on vehicle A receives vehicle address information from transponder 26 on vehicle C. The comparators within transponders 14 and 26 individually determine that vehicles A and C are on different tracks and the information is rejected as superfluous.

Transponder 14 on vehicle A receives vehicle address information from transponder 18 on vehicle B that indicates vehicle B is on the same track as vehicle A traveling in the same direction. The comparator within transponder 14 issues an alert to the operator of vehicle A of the presence of vehicle B.

Transponder 18 on vehicle B receives vehicle address information from transponder 14 on vehicle A that indicates vehicle A is on the same track as vehicle B traveling in the same direction. The comparator within transponder 18 issues an alert to the operator of vehicle B.

2. Single set of tracks, both vehicles moving.

Figure 4:
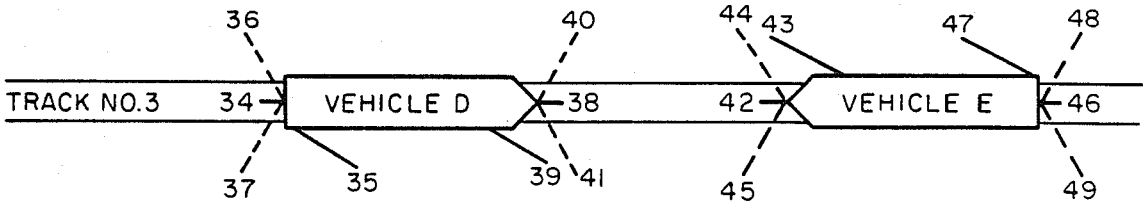
FIG. 4 illustrates vehicles D and E traveling in opposing directions on the same track No. 3.

Referring now to FIG. 4, vehicle D is traveling from left to right on track 3. One transponder 34 is mounted at the rear end of vehicle D transmitting vehicle D address information as per FIG. 1 based on information supplied by bar code reader 35 within a beam pattern indicated by dashed lines 36 and 37 and one transponder 38 is mounted at the front end of vehicle D transmitting vehicle D address information as per FIG. 1 based on information supplied by bar code reader 39 within a beam pattern indicated by dashed lines 40 and 41.

Vehicle E is traveling from right to left on track 3. One transponder 42 is mounted at the front end of vehicle E transmitting vehicle E address information as per FIG. 1 based on information supplied by bar code reader 43 within a beam pattern indicated by dashed lines 44 and 45 and one transponder 46 is mounted at the rear end of vehicle E transmitting vehicle E address information as per FIG. 1 based on information supplied by bar code reader 47 within a beam pattern indicated by dashed lines 48 and 49.

Transponders 34 and 46 receive no transmission signals from any other transponders in this illustration.

Transponder 38 on vehicle D receives vehicle address information from transponder 42 on vehicle E that indicates that vehicle E is on the same track as vehicle D and traveling toward vehicle D. The comparator within transponder 38 issues an alarm to the operator of vehicle D of a possible collision with vehicle E.

Transponder 42 on vehicle E receives vehicle address information from transponder 38 on vehicle D that indicates that vehicle D is on the same track as vehicle E and traveling toward vehicle E. The comparator within transponder 42 issues an alarm to the operator of vehicle E of a possible collision with vehicle D.

3. Single set of tracks, vehicle F moving, vehicle G stopped or derailed.

Figure 5:
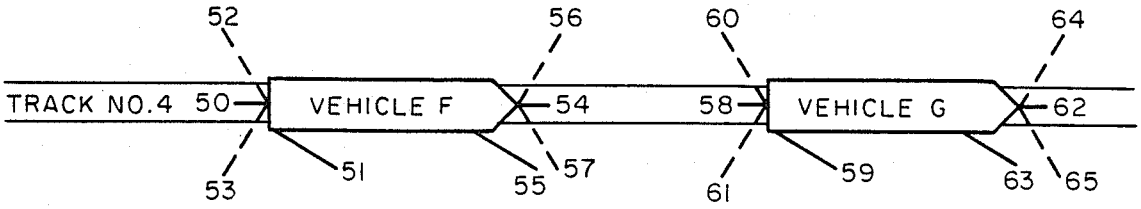
FIG. 5 illustrates vehicle F overtaking vehicle G on the same track No. 4.

Referring now to FIG. 5, vehicle F is traveling from left to right on track 4. One transponder 50 is mounted at the rear end of vehicle F transmitting vehicle F address information as per FIG. 1 based on information supplied by bar code reader 51 within a beam pattern indicated by dashed lines 52 and 53, and one transponder 54 is mounted at the front end of vehicle F transmitting vehicle F address information as per FIG. 1 based on information supplied by bar code reader 55 within a beam pattern indicated by dashed lines 56 and 57.

Vehicle G is stopped or derailed on track 4. One transponder 58 is mounted at the rear end of vehicle G transmitting vehicle G address information as per FIG. 1 based on information supplied by bar code reader 59 within a beam pattern indicated by dashed lines 60 and 61 and one transponder 62 is mounted at the front end of vehicle G transmitting vehicle G address information supplied by bar code reader 63 within a beam pattern indicated by dashed lines 64 and 65.

Transponders 50 and 62 receive no transmission signals from any other transponders in this illustration.

Transponder 54 on vehicle F receives vehicle address information from transponder 58 on vehicle G that indicates that vehicle G is on the same track as vehicle F and is stopped or derailed. The comparator within transponder 54 issues an alarm to the operator of vehicle F of a possible collision with vehicle G.

Transponder 58 on vehicle G receives vehicle address information from transponder 54 on vehicle F that indicates that vehicle F is on the same track as vehicle G and is moving toward vehicle G. The comparator within transponder 58 issues an alarm to the operator of vehicle G of a possible collision with vehicle F.

4. Junction in tracks

Figure 6:
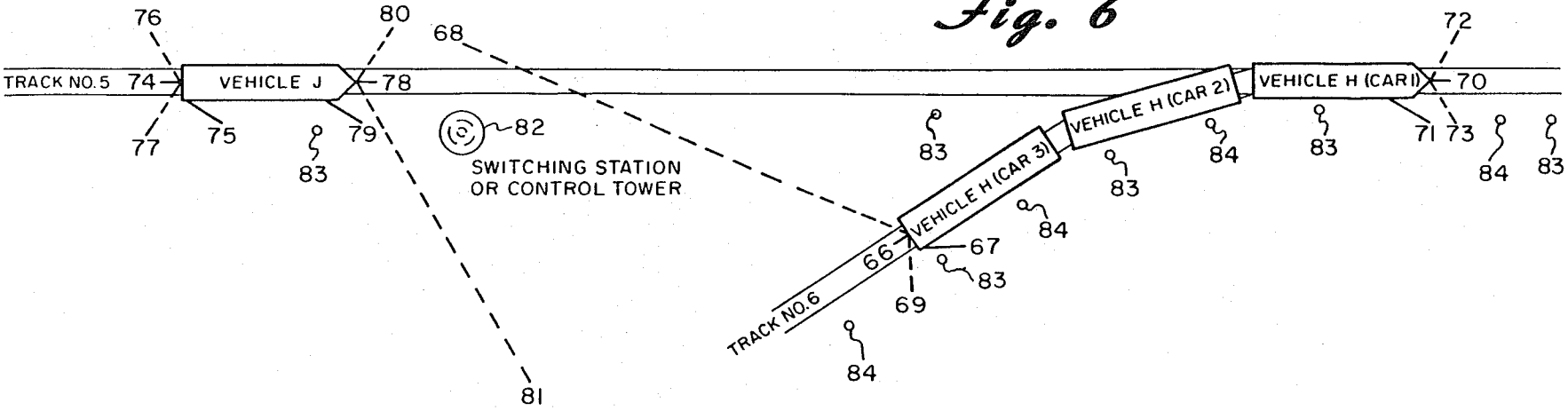
FIG. 6 illustrates vehicle H consisting of multiple units in transition from track No. 6 to track No. 5 with vehicle J approaching on track No. 5.

Referring now to FIG. 6, vehicle J is traveling from left to right on track 5. One transponder 74 is mounted at the rear end of vehicle J transmitting vehicle J address information as per FIG. 1 based on information supplied by bar code reader 75 within a beam pattern indicated by dashed lines 76 and 77 and one transponder 78 is mounted at the front end of vehicle J transmitting vehicle J address information as per FIG. 1 based on information supplied by bar code reader 79 within a beam pattern indicated by dashed lines 80 and 81.

Vehicle H is traveling from left to right on track 6. One transponder 66 is mounted at the rear end of vehicle H-3 transmitting vehicle H address information as per FIG. 1 based on information supplied by bar code reader 67 within a beam pattern indicated by dashed lines 68 and 69 and one transponder 70 is mounted at the front end of vehicle H-1 transmitting vehicle H address information supplied by bar code reader 71 within a beam pattern indicated by dashed lines 72 and 73.

Transponders 70 and 74 receive no transmission signals from any other transponder in this illustration.

Bar coded charts 83 on both tracks 5 and 6 post track 5 address whereas bar coded charts 84 on track 6 post track 6 address only.

Transponder 66 on vehicle H car 3 receives vehicle address information from transponder 78 on vehicle J that indicates that vehicle J is approaching the junction which vehicle H is in the process of negotiating, i.e. same track. The comparator within transponder 66 issues an alarm to the operator of vehicle H of a possible collision with vehicle J.

Transponder 78 on vehicle J receives vehicle address information from transponder 66 on vehicle H car 3 that indicates that vehicle H is in the process of negotiating a junction to which vehicle J is approaching, i.e. same track. The comparator within transponder 78 issues an alarm to the operator of vehicle J of a possible collision with vehicle H.

Simultaneously switching station or control tower 82 receives vehicle address information from transponders 66 and 78 that indicate a possible collision between vehicles H and J to be used to issue trackside warning signals.

D. Signal Tower and Switching Station Equipment

Figure 7:
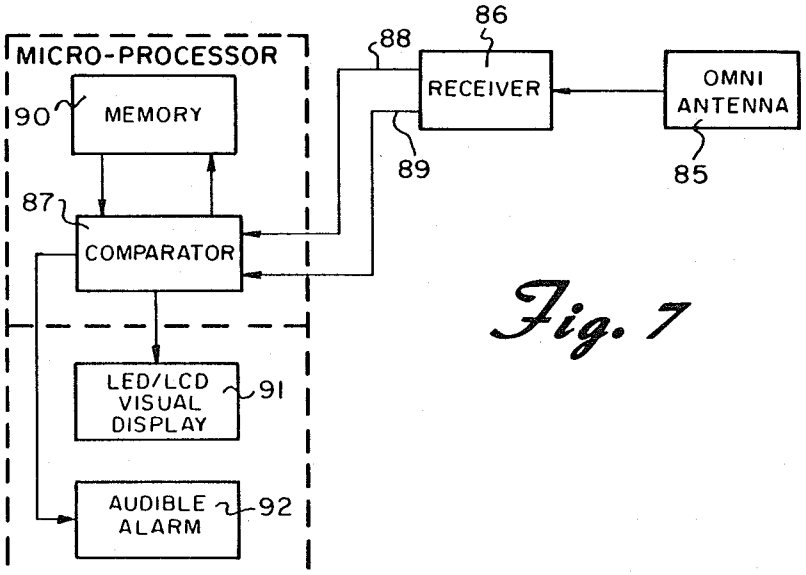
FIG. 7 is a block diagram illustrating signal tower and switching station equipment.

Referring now to FIG. 7, signal towers and switching stations along the railroad lines may be provided with equipment similar to certain components shown in FIG. 2.

All vehicle address information transmissions within the proximity of the signal tower or switching station are received by an omnidirectional antenna 85 and fed to a receiver 86. The receiver 86 will detect the amplitude modulated binary data from the RF component and process it to the comparator 87 via line 88. The receiver 86 will also discriminate the frequency modulated speed information from the RF component and process it to comparator 87 via line 89. Receiver 86 is congruent to receiver 116 shown in FIG. 2.

The comparator 87 compares each vehicle address information with all other vehicle address information stored in a memory 90 and the comparator 87 also sends a sample of each vehicle address information to memory 90. The memory 90 must have the capability of storing each vehicle address information that starts with a parity bit for a period of one second after which time each section of the memory 90 will be sequentially erased and made available to accept new data. The comparator 87 also sends each individual vehicle address information that starts with a parity bit to a multichannel LED/LCD visual display 91 where each will be displayed individually. The comparator 87 will also activate an audible alarm 92 at the signal tower or switching station if any two compared vehicle address information signals indicate an anomaly or a collision is pending.

This system can be used for automated control or can be used to augment manual operations.

E. In general

The foregoing description of the railway anticollision system of the present invention has been described in respect to directional antennas located on the front and rear of the train which transmit and receive signals forwardly and rearwardly respectively. However, in short trains or trains involving a single car, a single omnidirectional antennae may be employed.

As heretofore described, whenever two trains are in reception proximity of one another, the trains will demonstrate through the visual display the various relevant data and, whenever a potential danger exists, an audible alarm will be sounded. In addition to the visual display and the audible alarm, additional devices may be employed which will automatically apply the brakes to a moving train after a predetermined time interval upon the existence of a situation indicating a potential collision.

The railway anticollision apparatus and method of the present invention has been described in respect to the particular embodiments set forth in the specification and shown in the drawings. No limitation as to the scope of the invention is intended by the description thereof in respect to the particular embodiments set forth in the specification and the drawings but the scope of the invention is to be interpreted in view of the appended claims.

What is claimed is:

1. Railway anticollision apparatus comprising:

a plurality of optically machine readable trackside markers positioned at preselected trackside positions and providing as trackside marker information a track location position;

optical means positioned within a given train for reading a given trackside marker; and communication means carried by each train for transmitting and receiving between trains the respective trackside marker information and processing the same to provide an indication of a potential collision.

2. The railway anticollision apparatus of claim 1 wherein the trackside marker provides trackside marker information of track direction.

3. The railway anticollision apparatus of either claims 1 or 2 wherein the trackside marker provides trackside marker information of track number.

4. The railway anticollision apparatus of claim 3 wherein each train includes train identification means providing a train identification signal which is communicated to the respective trains by means of the communication means.

5. The railway anticollision apparatus of claim 4 wherein each train includes speed indicating means providing a speed indication signal which is communicated between respective trains by means of the communication means.

6. The method of preventing railway collisions comprising:

placing at preselected positions along the track side, optical machine reading trackside markers providing the information of track direction, track position and track identification;

reading the machine readable trackside markers by optical machine readable devices positioned upon a given train;

generating a train speed indication signal;

generating a train identification signal;

communicating between respective trains within a prescribed proximity the information of track identification, track position, track direction, train speed and train identification; and processing the communicated information upon each respective train to provide indications of a potential collision situation.

* * * * *